US005727743A

United States Patent [19]

Schneid et al.

[11] Patent Number: 5,727,743

[45] Date of Patent: Mar. 17, 1998

[54] DEVICE AND TREATMENT MACHINE FOR THE MECHANICAL TREATMENT OF HIGH-CONSISTENCY FIBROUS MATERIAL

[75] Inventors: Josef Schneid, Vogt; Hans Schnell, Mengen, both of Germany

[73] Assignee: Voith Sulzer Stoffaufbereitung, Ravensburg, Germany

[21] Appl. No.: 745,480

[22] Filed: Nov. 12, 1996

[30] Foreign Application Priority Data

Nov. 10, 1995 [DE] Germany ..... 195 41 892.1

[51] Int. Cl.[6] ..... B02C 7/12

[52] U.S. Cl. ..... 241/261.3; 241/297

[58] Field of Search ..... 241/261, 261.2, 241/261.3, 297, 296

[56] References Cited

U.S. PATENT DOCUMENTS

| | | | |
|---|---|---|---|
| 4,061,283 | 12/1977 | Kahmann | 241/261.3 |
| 4,383,650 | 5/1983 | Contal et al. | 241/66 |
| 4,431,482 | 2/1984 | Heinbockel et al. . | |
| 5,042,726 | 8/1991 | Reinhall | 241/28 |
| 5,476,228 | 12/1995 | Underberg . | |
| 5,509,610 | 4/1996 | Gibbons et al. | 241/37 |

FOREIGN PATENT DOCUMENTS

| | | |
|---|---|---|
| 1217754 | 5/1966 | Germany . |
| 3047013 | 7/1982 | Germany . |
| 9524528 | 9/1995 | WIPO . |

*Primary Examiner*—John M. Husar
*Attorney, Agent, or Firm*—Greenblum & Bernstein P.L.C.

[57] ABSTRACT

Treatment tools for the mechanical treatment of high-consistency fibrous material, and preferably for dispersing waste paper. The treatment tools are provided with teeth and are moved past one another with tight spacing so that the fibrous material disposed between treatment tool may be subjected to high shearing forces. Because of the intense loading of the teeth, the teeth may be arranged together in groups. The groups established according to at least two different, predetermined axial length gaps between each of the teeth of the treatment tools. As a result, a higher mechanical strength of the teeth is achieved and a large through flow area is offered for the material to be treated.

24 Claims, 4 Drawing Sheets

Fig. 3a
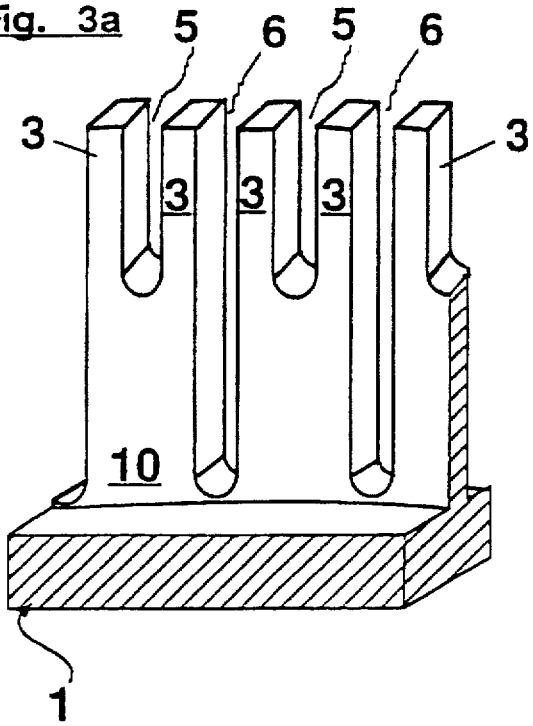
Fig. 3b
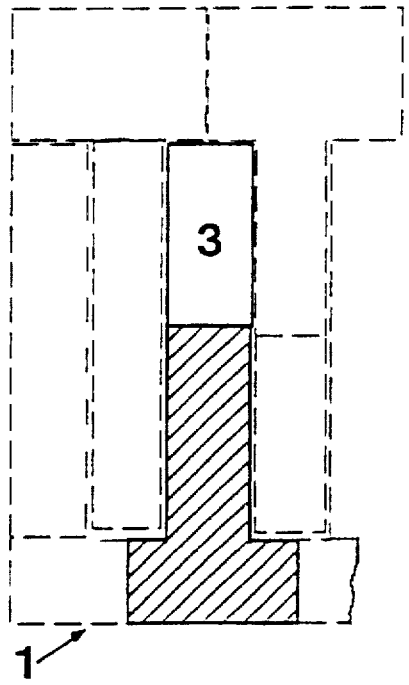
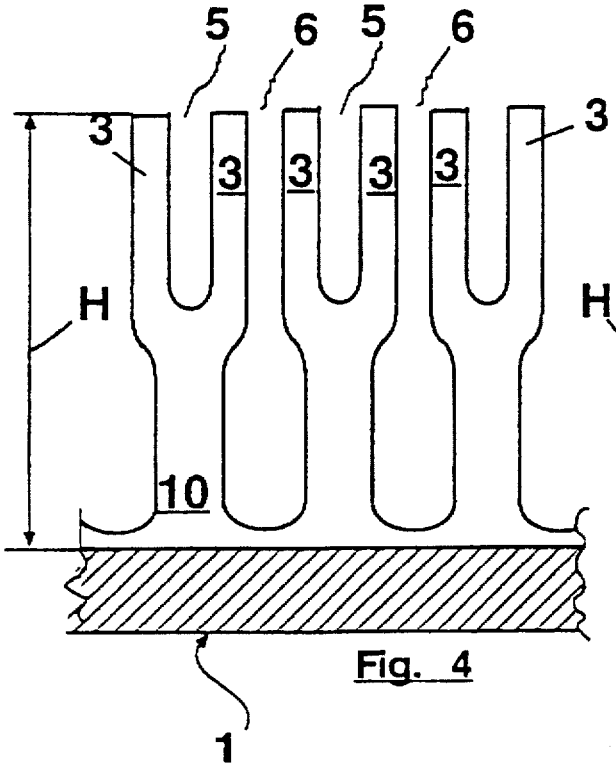
Fig. 4
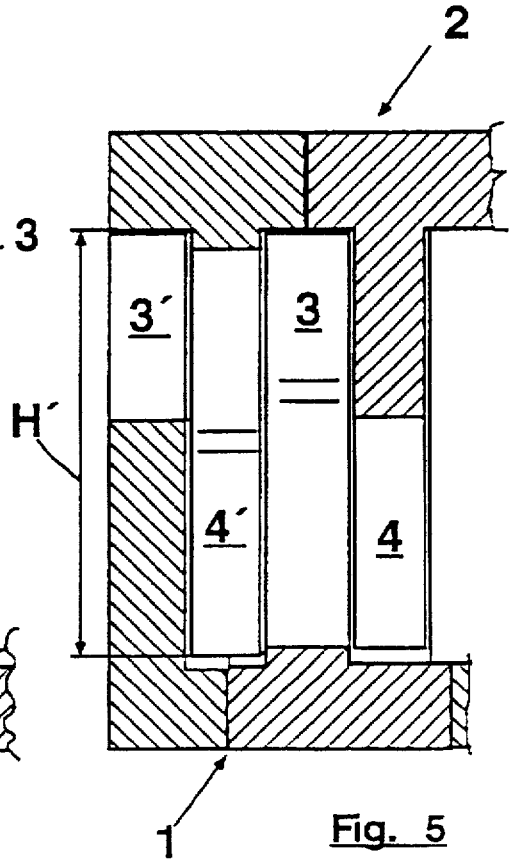
Fig. 5

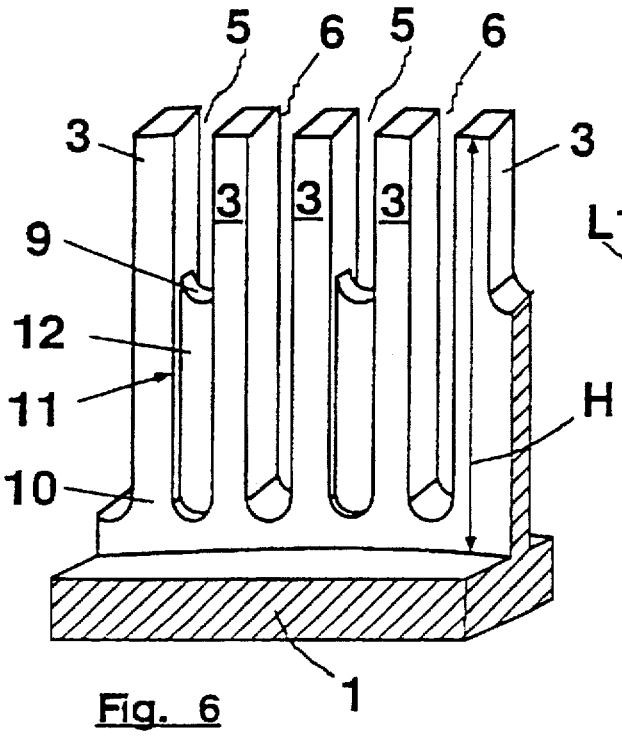
Fig. 6
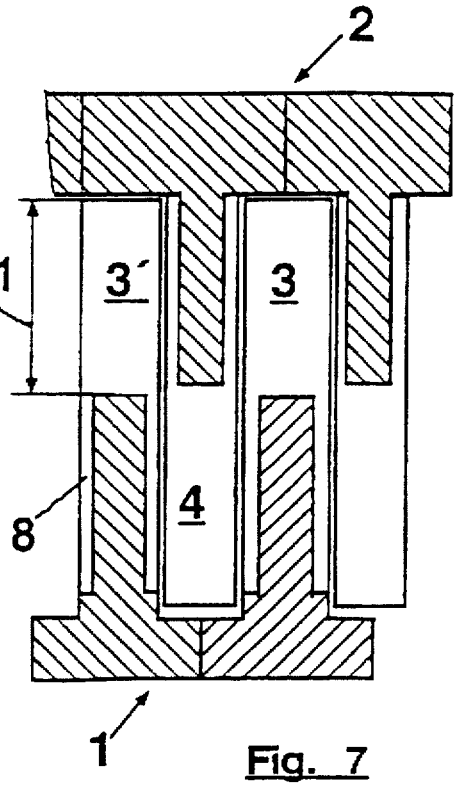
Fig. 7
Fig. 8
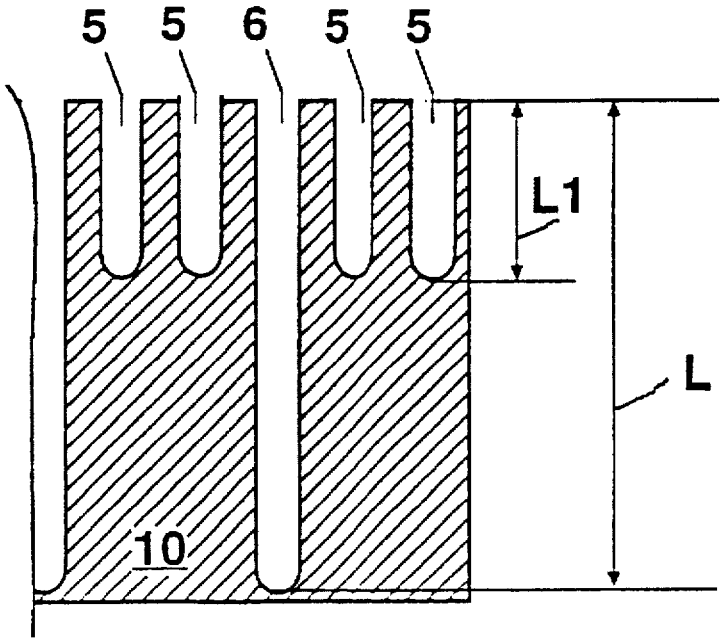

DEVICE AND TREATMENT MACHINE FOR THE MECHANICAL TREATMENT OF HIGH-CONSISTENCY FIBROUS MATERIAL

CROSS-REFERENCE OF RELATED APPLICATIONS

The present invention claims the priority under 35 U.S.C. §119 of German Patent Application No. 195 41 892.1 filed on Nov. 10, 1995, the disclosure of which is expressly incorporated by reference herein in its entirety.

BACKGROUND OF THE INVENTION

1. Field of the invention

The present invention relates to a device for the mechanical treatment of high-consistency fibrous material that may include two treatment tools mounted for relative movement therebetween. The treatment tools may include a plurality of coaxially arranged rows of raised teeth, the rows of teeth for each treatment tool being received in a corresponding space in the other treatment tool. Adjacent teeth in each toothed row may form gaps of differing axial length.

2. Discussion of the Background Information

A treatment device for mechanical treatment of high-consistency fibrous material has been disclosed, for example, in German Patent No. 30 47 013, the disclosure of which is incorporated by reference herein in its entirety. This device, which is suited for dispersing waste paper, is used to intensively process the material in a mechanical and thermal fashion so that unwanted materials contained therein can be removed from the fibers, ground, and/or brought below the limit of visibility. In general, with devices for mechanical treatment of high-consistency fibrous material, the fibrous material is not processed in a suspension that can be pumped, but rather in the form of a doughy or crumbly high-consistency material, preferably with a dry content between 20 and 40%. In this manner, considerably higher shearing forces can be transmitted to the fibrous material, without a significant change in fiber length being correspondingly produced. In many cases, the action of the mechanical treatment is further reinforced by heat, e.g., by setting a fibrous material temperature of 90° C. or higher.

As a result of the high consistency that the fibrous material has during treatment, an intensive mechanical treatment is possible, even though the teeth of the treatment tools that move in relation to one another do not touch, but rather move past one another at a spacing of approx. 1 mm or more. In the process, considerable forces are exerted on the teeth, in particular at the foot of the tooth. Due to lever action, in addition to the shearing forces on the teeth, the tooth foot is engaged by a high moment that rises with increasing tooth height. Further, higher teeth are advantageous since the available through flow cross section is essentially proportional to tooth height. This is why, using one device, a correspondingly greater quantity of material can be treated in the same amount of time with equally high intensity. With larger machining units, a higher economy can almost always be achieved with regard to investment and operational costs.

For prior art devices for mechanical treatment of high-consistency fibrous material, tooth heights depend on the manufacturing process. Thus there are cast arcs, which are assembled by being placed against one another into a closed, annular rotor set or stator set. For technical casting and forming reasons, with components of this kind produced for example using the sand casting process, the gap width and tooth width cannot fall below 6 mm, and the tooth height mostly is not permitted to be more than 30 mm. Devices which are produced in a process of this kind can only have a comparatively low material hardness. The other working process is based on closed individual rings into which the gaps must be milled. These rings are assembled in concentric disposition into a complete rotor set or stator set. Because of the milling process, the gaps can be intrinsically smaller than in casting, but limitations arise due to strength requirements. Nevertheless, milled set rings can be produced with higher teeth than if they are cast. The high manufacture costs of milling, though, are disadvantageous.

SUMMARY OF THE INVENTION

The object of the invention, therefore, is to produce a device for the mechanical treatment of high-consistency fibrous material with which it is possible to process a greater throughput quantity than before while maintaining or improving the treatment action.

According to the above-noted features, the present invention may be directed to a device for mechanical treatment of high-consistency fibrous material, with at least two treatment tools that can be moved in relation to each other. The treatment tools may include a rotationally symmetrical base body and may be disposed coaxial to each other, and have teeth disposed in annular rows concentric to the centers of the treatment tools and have annular empty spaces between the rows of teeth. Gaps may be disposed between the teeth and form clear cross sections which fibrous material to be treated can flow through. The treatment tools may be positioned so that at least one row of teeth of one treatment tool reaches into an annular empty space of another treatment tool. The gaps, through which the fibrous material flows, have different respective lengths between adjacent teeth.

Accordingly, the present invention may be directed to a device for the mechanical treatment of high-consistency fibrous material including at least two treatment tools that can be moved in relation to each other. The at least two treatment tools may each have a substantially rotationally symmetrical base body and may be disposed coaxial to each other. The device may include a plurality of teeth disposed in annular rows concentric to centers of each of the treatment tools in which the plurality of teeth include gaps disposed between adjacent teeth to form clear cross sections to enable fibrous material to be treated to flow therethrough. The device may include annular empty spaces positioned between the annular rows of teeth on each treatment tool and the treatment tools may engage with one another such that at least one annular row of teeth of a first treatment tool is positioned within a corresponding annular empty space of a second treatment tool. The gaps may include different respective axial lengths between adjacent teeth.

In accordance with another feature of the present invention, the different respective axial lengths may include a short gap and a long gap, a length of the short gap being not more than approximately 70% of a length of the long gap.

In accordance with another feature of the present invention, each of the plurality of teeth may include a tooth foot, and each long gap may include a gap width, in a circumferential direction. The gap width adjacent to each tooth foot may be greater than the gap width axially displaced from the respective treatment tool.

In accordance with yet another feature of the present invention, the gap width adjacent each tooth foot may be approximately 1.2 times greater than the gap width axially displaced from the respective treatment tool.

In accordance with still another feature of the present invention, in at least one annular row of teeth, the long gaps and the short gaps may be arranged in alternating succession.

In accordance with still another feature of the present invention, in at least one annular row of teeth, at least two short gaps may be positioned adjacent each long gap.

In accordance with a still further feature of the present invention, in at least one annular row of teeth, at least two long gaps may be positioned adjacent each short gap.

In accordance with yet another feature of the present invention, each of the plurality of teeth may include an axial height between approximately 40 and 150 mm.

In accordance with another feature of the present invention, the axial height of the each tooth may be approximately equal to an axial length of the long gaps.

In accordance with still another feature of the present invention, the axial length of the long gap may be between approximately 40 and 150 mm.

In accordance with still another feature of the present invention, the axial length of the short gap may be between approximately 10 and 80 mm.

In accordance with yet another feature of the present invention, the gap width may be between approximately 5 and 30

In accordance with another feature of the present invention, the treatment tool may include a plurality of individual segments of one of a circle and a ring.

In accordance with another feature of the present invention, the treatment tools may be produced in one of a casting and injection process.

In accordance with another feature of the present invention, the rotationally symmetrical base body may include a plurality of concentric rows of teeth disposed radial to one another and two adjacent treatment tools, which can be moved in relation to each other, disposed axially adjacent to each other.

In accordance with yet another feature of the present invention, the device may be used in combination with a treatment machine that includes a housing, with at least one supply opening and at least one outlet opening, that essentially encompassing the first and second treatment tools. At the supply opening, the treatment machine may include a feed device that forms plugs and supplies a high-consistency fibrous material to be treated. The feed device may convey the high-consistency fibrous material between the relatively rotating treatment tools.

In accordance with a further feature of the present invention, the outlet opening may include a fall shaft for the treated high-consistency fibrous material.

In accordance with a still further feature of the present invention, devices for adding water for the treated, high-consistency fibrous material may be positioned upstream from the treatment tools.

Alternatively, the present invention may be directed to a device for mechanically treating a high-consistency fibrous material. The device may include first and second treatment tools mounted for relative rotation. Each treatment tool may include a plurality of annular toothed rows and each the annular toothed rows may include a plurality of teeth and an adjacent gap between each of the plurality of teeth. Further, each adjacent gap, which may include one of a first axial length and a second axial length, enables the fibrous material to move through the device. The first axial length and the second axial length may include different lengths.

In accordance with another feature of the present invention, the device may also include a plurality of annular spaces positioned between each of the plurality of annular toothed rows, such that each of the annular toothed rows on the first treatment tool may be arranged for insertion into a respective one of the plurality of annular spaces.

In accordance with yet another feature of the present invention, the device may further include that each of the plurality of teeth may include an equivalent axial height, that the first axial length may include a length substantially equal to the axial height of the teeth, and that the second axial length may include a length less than or equal to approximately 70% of the first axial length.

In accordance with another feature of the present invention, each adjacent gap may include a gap width in a circumferential direction, where the gap width associated with the first axial length and the gap width associated with the second axial length may be substantially equal.

In accordance with yet another feature of the present invention, each adjacent gap may include a gap width in a circumferential direction, where the gap width associated with the first axial length may include a first and second gap width and the first gap width adjacent a tooth foot may be greater than the second gap width axially displaced from the tooth foot.

In accordance with a still further feature of the present invention, the device may also include tooth material positioned between adjacent teeth to define the second axial length, where the tooth material may include a radial thickness which is less than a radial thickness of the plurality of teeth.

In accordance with the present invention, the through flow cross sections which are between the teeth and are available to the fibrous material can be increased without risk of overloading the tooth feet. Where the gaps are axially short, the loads are relatively slight and where these gaps are axially long, correspondingly wide tooth feet can absorb very high loads. The resistance moment increases in a known manner with the square of the foot width.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein:

FIG. 3*a* shows a perspective representation of a part of the treatment tool;

FIG. 3*b* shows a side view with regard to FIG. 3*a;*

FIG. 4 shows a partial view of another embodiment of a treatment tool;

FIG. 5 shows the variant in FIG. 4, engaging with other treatment tools;

FIG. 6 shows another embodiment;

FIG. 7 shows the variant in FIG. 6, engaging with other treatment tools;

FIG. 8 shows another variant of a treatment tool; and

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
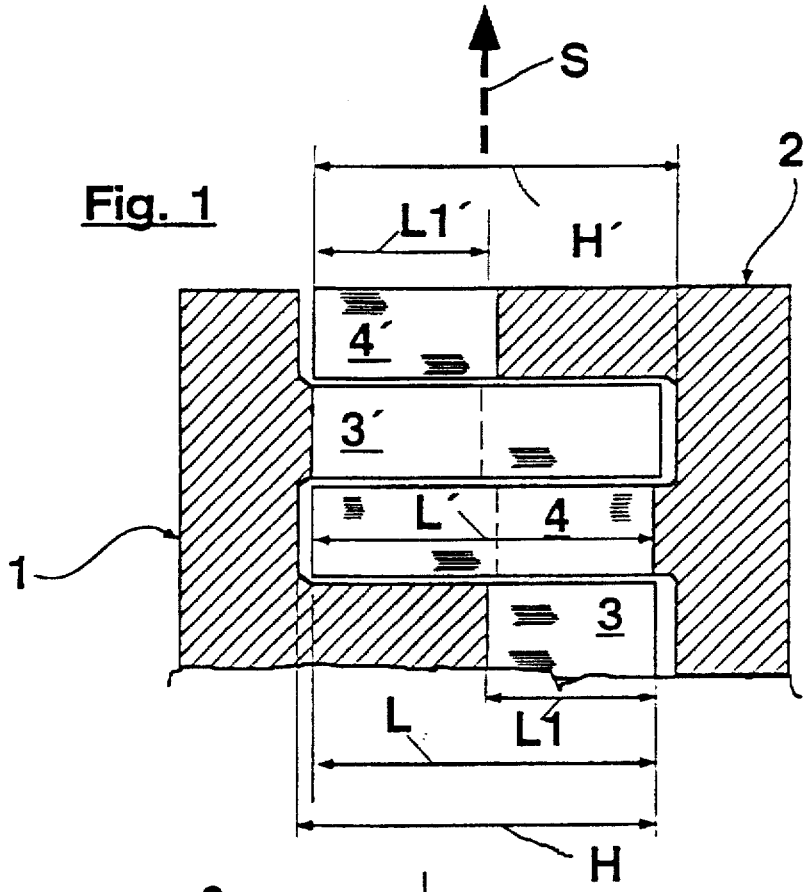
FIG. 1 shows a section through a side view of the essential part of the device according to the invention.

FIG. 1 shows two complementary treatment tools 1 and 2 which can be moved in relation to each other and which engage each other so that they can cooperate. For example, treatment tool 1 can be affiliated with a rotor and treatment tool 2 can be affiliated with a stator. At the same time, therefore, in the case represented here, the treatment tool, viewed in the flow direction, is radially closed off on the outside by a stator. It is easily conceivable that the last ring from a radial standpoint is a rotor ring, by means of which, for example, the material would be centrifuged out from the treatment apparatus. The selected representation in the form of a sectional side view, shows that the teeth 3, 4, 3', 4' affiliated with different treatment tools alternate from the inside to the outside, radially speaking. Their axial height is indicated as H or H'. The direction of the material flow, radially outward from the inside, is indicated by arrow S.

Figure 2:
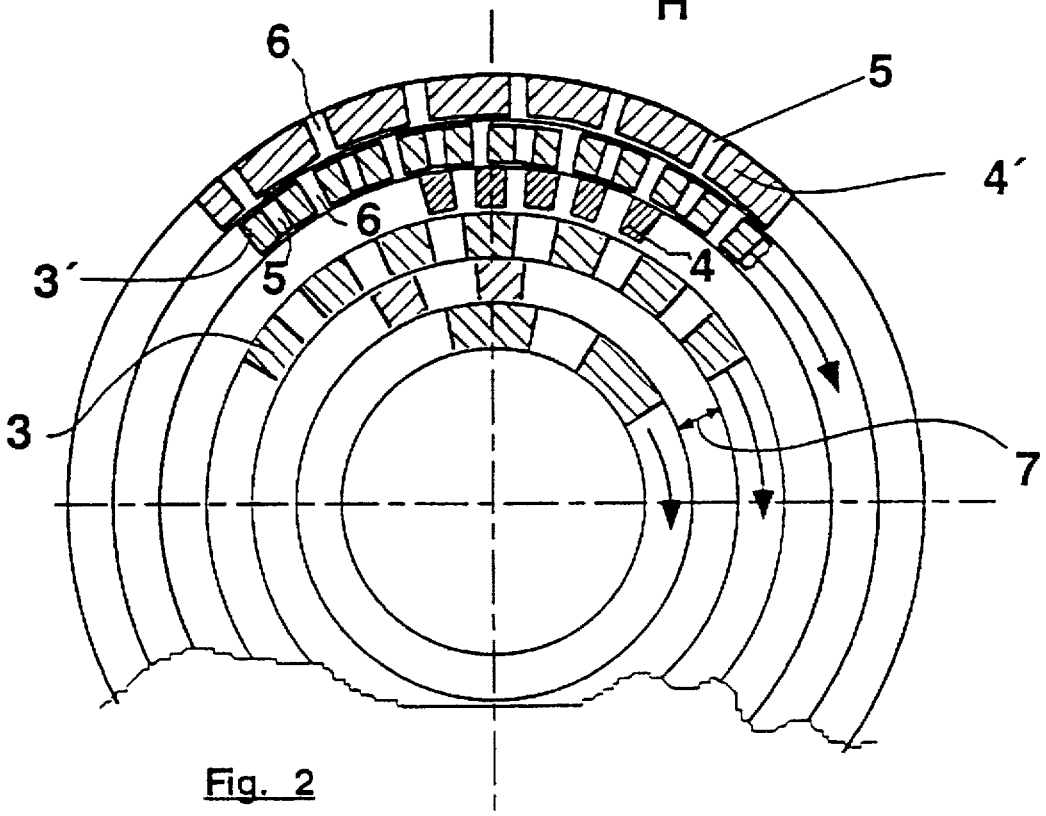
FIG. 2 shows a top view of the device.

As FIG. 2 shows, the apparatus is of such a kind that teeth disposed in an annular patterns respectively forming a plurality of toothed rows with an empty space 7 formed between the annular toothed rows. When the treatment tools are engaged, the row of teeth of one treatment tool reaches into the empty space 7 of the complementary tool, and vice versa. As has already been explained, the gaps between neighboring teeth may be of different lengths. This is represented in FIG. 1, with measurement arrows and the letters being plotted on treatment tool 1, L for the length of the respectively longer gap and L1 for the length of the respectively shorter gap. On treatment tool 2, this geometry is dimensioned analogously with the reference numerals L' and L1'. Thus, the present invention enables utilizing treatment tool teeth which are axially longer and more stable than the teeth available in the prior art, for example, the axial height H, H' may be between approximately 40 mm and 150 mm, the axial length of the gaps L, L' may be between approximately 40 mm and 150 mm, and the axial length of the gaps L1, L1' may be between approximately 5 mm and 30 mm. However, the axial length of the short gap should not be greater than 70% of the axial length of the long gap.

FIG. 2 shows a top view of a device embodied according to the invention, wherein the teeth are represented in partial section. Only a part of the teeth that are available per se is depicted. The teeth are clearly disposed in concentric rows of teeth. The gaps 5 or 6 are disposed between the teeth 3, 3', 4, 4'. The teeth 3 and 3' are affiliated with one treatment tool and the teeth 4 and 4' are affiliated with the other. The drawing sections through the teeth 3' are laid out so that they capture all the gaps 5 and 6, while those sections through the teeth 4' are disposed close to the tooth foot so that they are only interrupted by the long gaps 6. It should be noted that not necessarily all rows of teeth have to be provided with gaps of different lengths. This measure is particularly advantageous on the rows of teeth disposed on the radial outside.

For better explanation of the device, FIG. 3*a* shows a perspective drawing of an exemplary embodiment. The treatment tool 1, which is only shown partially, includes an annular tooth row with teeth 3, which are divided from each other by gaps 5 and 6 that are of different lengths. The width of these gaps in the circumference direction can be kept equal in order to assure an even processing of all of the material. This does not have to be optimal in every case; e.g., the longer gap 6 can be selected as wider in order to then improve the through flow of material. This kind of optimization must take economy and technology into account. A side view of the embodiment shown in FIG. 3*a* is depicted in FIG. 3*b*, in schematic section. FIG. 3*b* shows two treatment tools 1 and 2, which are disposed engaged so that a proper use of the treatment device is possible. FIG. 3*b* also shows that each treatment tool may comprise a plurality of individual segments of circle or a ring.

The embodiment of the treatment tool according to FIG. 4 likewise includes a greater number of teeth 3, between which the gaps 5 and 6 of different lengths are disposed. In this form, the longer gaps 6 are enlarged in the circumference direction in the region of the tooth foot 10. As a result, a maximal through flow area is offered for the material to be treated. In this alternative, the circumferential gap width at the tooth foot may be at approximately 1.2 times greater than the circumferential gap width at a position axially displaced from the tooth foot. As has already been embodied, the possible throughput of a treatment tool of this kind is essentially proportional to the through flow cross section. Naturally, the tooth feet formed in the region of the long gaps 6 must also have a sufficient wall thickness in order to be able to absorb the considerable forces and moments at this location. In principle, the treatment tool 2 that cooperates with the treatment tool 1 shown here can be embodied in a similar fashion. The side view shown in FIG. 5, in schematic section, shows two treatment tools 1 and 2, which are disposed engaged so that a proper use of the treatment device is possible. FIG. 5 also shows that each treatment tool may comprise a plurality of individual segments of circle or a ring.

Another possibility for realizing the invention is shown in FIGS. 6 and 7. Shown in the example of the treatment tool 1, though, a particular shape can be seen, in which the shorter gaps 5 also do in fact have only the shorter length L1, but there is a groove 11 between the bottom face 9 of the shorter gap 5 and the tooth foot 10. As a result, in operation of the device, there are additional edges, which can be advantageous. Because of the remaining tooth material 12, though, a support of the neighboring teeth 3 is nevertheless possible. FIG. 7 shows a sectional side view of the subject of FIG. 6, wherein another treatment tool 2 is additionally shown in turn, which tool engages treatment tool 1.

The use of the invention can also be carried out with a treatment tool according to FIG. 8 in which the long and short gaps 5 and 6 do not follow one another in uniform succession, but rather each long gap 6 is followed by two short gaps 5. The device shown results in heavy tooth feet 10 and thus often permits even higher teeth.

In accordance with economical and technical requirements, other variations of the order of short and long gaps are also conceivable.

Figure 9:
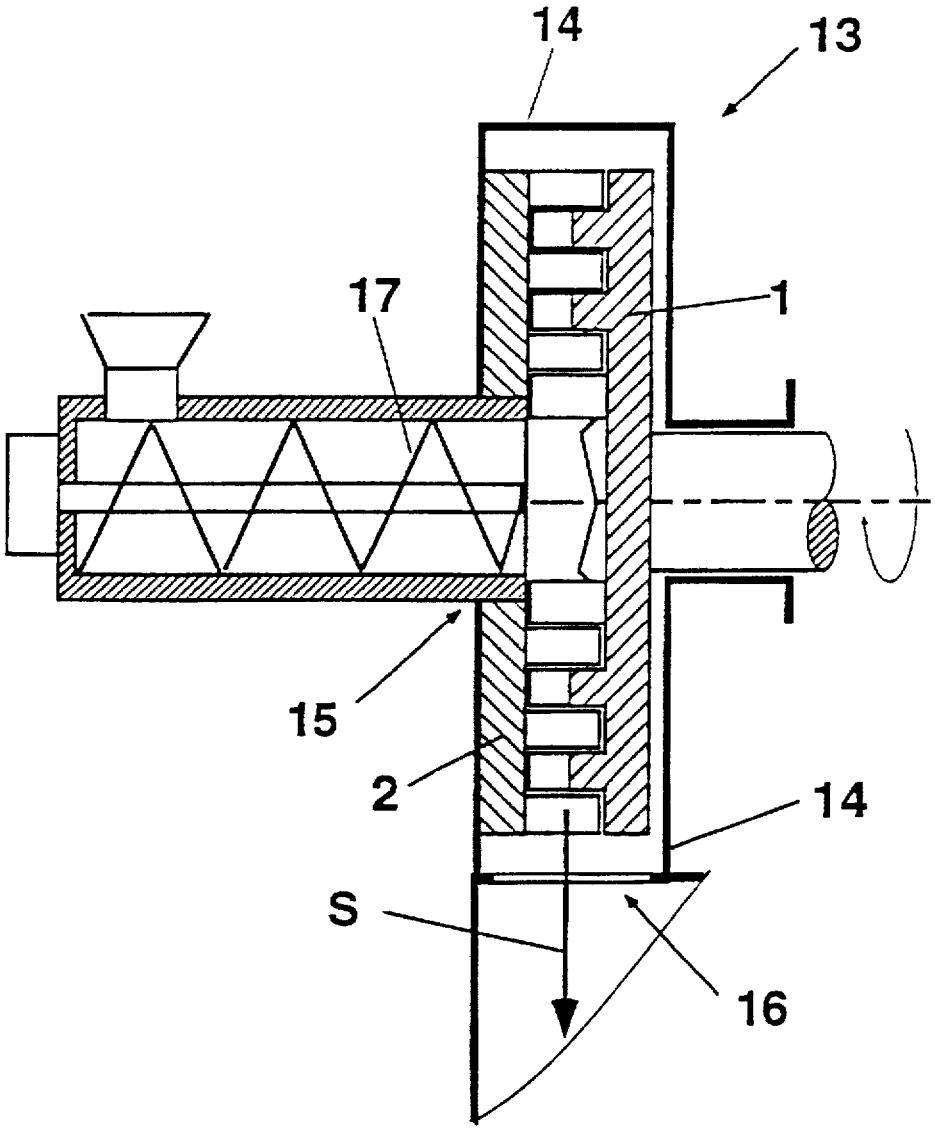
FIG. 9 shows a section through a treatment machine which contains the device.

FIG. 9 shows a treatment machine 13 into which two treatment tools 1, 2 are inserted. A housing 14 essentially encompasses these and has a supply opening 15 and an outlet opening 16, through which the fibrous material is to be supplied or discharged. At the supply opening 15, the machine has a feed device 17, which compresses the crumbly, high-consistency material so that a plug is produced. The fibrous material is conveyed between the treatment tools 1, 2, radially outward (arrow S) and then leaves the housing 14 through the outlet opening 16. Treatment machine 13 may also include devices (not shown) for adding diluting water to the fibrous material as it is being conveyed toward the treatment tools 1 and 2.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for the mechanical treatment of high-consistency fibrous material including at least two treatment tools that can be moved in relation to each other, the at least two treatment tools each have a substantially rotationally symmetrical base body and are disposed coaxial to each other and comprise:

a plurality of teeth disposed in annular rows concentric to centers of each of the treatment tools;

the plurality of teeth including gaps disposed between adjacent teeth to form clear cross sections, the gaps enabling fibrous material to be treated to flow therethrough;

annular empty spaces positioned between the annular rows of teeth on each treatment tool;

the treatment tools engaging with one another such that at least one annular row of teeth of a first treatment tool is positioned within a corresponding annular empty space of a second treatment tool;

the gaps include different respective axial lengths between adjacent teeth.

2. The device according to claim 1, the different respective axial lengths comprising a short gap and a long gap, a length of the short gap being not more than approximately 70% of a length of the long gap.

3. The device according to claim 2, each of said plurality of teeth comprising a tooth foot, and each long gap comprising a gap width, in a circumferential direction, wherein the gap width adjacent to each tooth foot is greater than the gap width axially displaced from the respective treatment tool.

4. The device according to claim 3, the gap width adjacent each tooth foot is approximately 1.2 times greater than the gap width axially displaced from the respective treatment tool.

5. The device according to claim 2, in at least one annular row of teeth, the long gaps and the short gaps are arranged in alternating succession.

6. The device according to claim 2, in at least one annular row of teeth, at least two short gaps are positioned adjacent each long gap.

7. The device according to claim 2, in at least one annular row of teeth, at least two long gaps are positioned adjacent each short gap.

8. The device according to claim 2, each of the plurality of teeth include an axial height between approximately 40 and 150 mm.

9. The device according to claim 8, the axial height of the each tooth is approximately equal to an axial length of the long gaps.

10. The device according to claim 2, the axial length of the long gap is between approximately 40 and 150 mm.

11. The device according to claim 2, the axial length of the short gap is between approximately 10 and 80 mm.

12. The device according to claim 2, the gap width is between approximately 5 and 30 mm.

13. The device according to claim 2, the treatment tool comprises a plurality of individual segments of one of a circle and a ring.

14. The device according to claim 2, the treatment tools are produced in one of a casting and injection process.

15. The device according to claim 2, the rotationally symmetrical base body includes a plurality of concentric rows of teeth disposed radial to one another and two adjacent treatment tools, which can be moved in relation to each other, disposed axially adjacent to each other.

16. The device according to claim 2 in combination with a treatment machine, the treatment machine comprising:

a housing with at least one supply opening and at least one outlet opening, the housing essentially encompassing the first and second treatment tools;

at the supply opening, the treatment machine includes a feed device that forms plugs and supplies a high-consistency fibrous material to be treated, the feed device conveying the high-consistency fibrous material between the relatively rotating treatment tools.

17. The treatment machine according to claim 16, the outlet opening includes a fall shaft for the treated high-consistency fibrous material.

18. The treatment machine according to claim 16, further comprising devices for adding water for the treated, high-consistency fibrous material positioned upstream from the treatment tools.

19. A device for mechanically treating a high-consistency fibrous material comprising:

first and second treatment tools, said first and second treatment tool mounted for relative rotation;

each treatment tool comprising a plurality of annular toothed rows, each said annular toothed row comprising a plurality of teeth and an adjacent gap between each of said plurality of teeth;

each adjacent gap, comprising one of a first axial length and a second axial length, enabling the fibrous material to move through said device, said first axial length and said second axial length comprising different lengths.

20. The device according to claim 19, further comprising:

a plurality of annular spaces positioned between each of said plurality of annular toothed rows, each said annular toothed rows on said first treatment tool arranged for insertion into a respective one of said plurality of annular spaces.

21. The device according to claim 19, further comprising:

each of said plurality of teeth comprising an equivalent axial height;

said first axial length comprising a length substantially equal to said axial height of said teeth;

said second axial length comprising a length less than or equal to approximately 70% of said first axial length.

22. The device according to claim 21, each said adjacent gap comprising a gap width in a circumferential direction, said gap width associated with said first axial length and said gap width associated with said second axial length being substantially equal.

23. The device according to claim 21, each said adjacent gap comprising a gap width in a circumferential direction, said gap width associated with said first axial length comprising a first and second gap width, said first gap width adjacent a tooth foot being greater than said second gap width axially displaced from said tooth foot.

24. The device according to claim 21, further comprising tooth material positioned between adjacent teeth to define said second axial length, said tooth material comprising a radial thickness which is less than a radial thickness of said plurality of teeth.

* * * * *